US010876272B2

(12) United States Patent
Faivre et al.

(10) Patent No.: US 10,876,272 B2
(45) Date of Patent: Dec. 29, 2020

(54) SYSTEMS AND METHODS FOR CONTROLLING A MACHINE IMPLEMENT

(71) Applicant: Caterpillar Inc., Deerfield, IL (US)

(72) Inventors: Joe Faivre, Edelstein, IL (US); Bradley P. Krone, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 182 days.

(21) Appl. No.: 16/101,056

(22) Filed: Aug. 10, 2018

(65) Prior Publication Data

US 2020/0048863 A1 Feb. 13, 2020

(51) Int. Cl.

| | |
|---|---|
| ***E02F 3/84*** | (2006.01) |
| ***E02F 3/76*** | (2006.01) |
| ***E02F 9/26*** | (2006.01) |
| *E02F 3/43* | (2006.01) |

(52) U.S. Cl.

CPC ..... *E02F 3/845* (2013.01); *E02F 3/7618* (2013.01); *E02F 3/847* (2013.01); *E02F 3/436* (2013.01); *E02F 9/265* (2013.01)

(58) Field of Classification Search

USPC ..... 701/50

See application file for complete search history.

(56) References Cited

U.S. PATENT DOCUMENTS

| | | | | |
|---|---|---|---|---|
| 7,121,355 | B2 | 10/2006 | Lumpkins et al. | |
| 8,406,963 | B2 | 3/2013 | Farmer et al. | |
| 8,738,242 | B2 | 5/2014 | Konno et al. | |
| 9,222,237 | B1 | 12/2015 | Green et al. | |
| 9,238,479 | B2 | 1/2016 | Smith et al. | |
| 9,551,130 | B2 | 1/2017 | Hendron et al. | |
| 9,580,104 | B2 | 2/2017 | Green et al. | |
| 10,066,367 | B1 * | 9/2018 | Wang | E02F 9/262 |
| 10,066,370 | B2 * | 9/2018 | Faivre | E02F 9/2029 |
| 2005/0211451 | A1 * | 9/2005 | Matsumoto | E02F 3/815 172/811 |
| 2006/0070746 | A1 * | 4/2006 | Lumpkins | E02F 3/844 172/2 |
| 2007/0209811 | A1 * | 9/2007 | Matsumoto | E02F 3/7613 172/811 |
| 2009/0112410 | A1 * | 4/2009 | Shull | B25J 9/1664 701/50 |
| 2009/0178817 | A1 * | 7/2009 | Matsumoto | E02F 3/815 172/811 |
| 2010/0299031 | A1 * | 11/2010 | Zhdanov | E02F 3/845 701/50 |

(Continued)

*Primary Examiner* — Tyler D Paige

(74) *Attorney, Agent, or Firm* — Bookoff McAndrews

(57) ABSTRACT

A control system for a machine may include a chassis an implement attached to the chassis, a first sensor, a second sensor, and a controller in communication with the first and second sensors. The first sensor may be configured to generate a first signal indicative of an angle of the implement with respect to the chassis. The second sensor may be configured to generate a second signal indicative of an angle of the chassis with respect to gravity. The controller may be configured to determine an implement mainfall angle based on the first signal and the second signal; process the second signal using a low pass filter to determine a filtered chassis pitch angle; determine a target mainfall angle based on the first signal and the filtered chassis pitch angle; and generate a command signal based the target mainfall angle and the implement mainfall angle.

20 Claims, 5 Drawing Sheets

(56) References Cited

U.S. PATENT DOCUMENTS

| | | | | |
|---|---|---|---|---|
| 2012/0073843 | A1* | 3/2012 | Kure | E02F 9/2257 172/407 |
| 2013/0261902 | A1* | 10/2013 | Zhdanov | E02F 3/7613 701/50 |
| 2015/0361640 | A1 | 12/2015 | Faivre et al. | |
| 2016/0230367 | A1 | 8/2016 | Hendron et al. | |
| 2017/0107700 | A1* | 4/2017 | Faivre | E02F 9/2029 |
| 2019/0280674 | A1* | 9/2019 | Berkemeier | H03H 17/0257 |
| 2020/0048863 | A1* | 2/2020 | Faivre | E02F 3/7618 |
| 2020/0071909 | A1* | 3/2020 | Harada | E02F 3/43 |

* cited by examiner

SYSTEMS AND METHODS FOR CONTROLLING A MACHINE IMPLEMENT

TECHNICAL FIELD

This disclosure relates generally to a machine having an implement, and more particularly to a method of controlling the position and movement of the implement.

BACKGROUND

Earth moving machines, such as, e.g., tractors, bulldozers, excavators, and material handlers may be equipped with work implements to perform various functions. For example, a tractor may be equipped with a work implement in the form of a blade for contouring or leveling a ground surface during construction. The position and movement of the work implement may be controlled by an operator and/or a controller. During operation, the machine may traverse uneven terrain, causing the machine to pitch forward and/or aft. The operator and/or controller may compensate for change in pitch of the machine to maintain a desired implement position or movement path.

One method for compensating for changes in pitch of the machine includes operators manually adjusting the motion and position of the implement. However, even very skilled operators may have difficulty anticipating movement of the implement in response to uneven terrain. As a result, operators may undercorrect or overcorrect the position and/or movement of the implement. Some machines include a control system to adjust the position and movement of the implement based on a variety of inputs. Such control systems may attempt to adjust for instantaneous changes in the pitch of the machine or implement, but such control systems may not adequately address these situation.

U.S. Pat. No. 9,328,479 to Rausch et. al ("the '479 patent") discloses a grade control system for controlling a ground-engaging blade. The system includes a controller configured to receive machine chassis and blade inclination signals, determine a target grade, determine a distance error based on the signals indicative of a distance between the blade and the target grade, and send a command to move the blade toward the target grade based on the distance error. The control system of the '479 patent may not sufficiently control the blade during all modes and condition of the machine.

The of the present disclosure may solve one or more of the problems set forth above and/or other problems in the art. The scope of the disclosure, however, is not defined by the ability to solve any specific problem.

SUMMARY OF THE DISCLOSURE

According to one aspect of the present disclosure, a control system for a machine may include a chassis, an implement attached to the chassis, a first sensor, a second sensor, and a controller. The first sensor may be configured to generate a first signal indicative of an angle of the implement with respect to the chassis. The second sensor may be configured to generate a second signal indicative of an angle of the chassis with respect to gravity. The controller may be in communication with the first and second sensors. The controller may be configured to determine an implement mainfall angle based on the first signal and the second signal. The controller may be configured to process the second signal using a low pass filter to determine a filtered chassis pitch angle. The controller may be further configured to determine a target mainfall angle based on the first signal and the filtered chassis pitch angle. The controller may be configured to generate a command signal based the target mainfall angle and the implement mainfall angle.

According to another aspect of the present disclosure, a method of controlling an implement of a machine may include receiving at a controller an implement pitch signal indicative of an angle of the implement with respect to the chassis, a chassis pitch signal indicative of an angle of the chassis with respect to gravity, and a speed signal indicative of a speed of the machine. A low pass filter may be adjusted based the speed signal. The chassis pitch signal may be filtered through the low pass filter to produce a filtered chassis pitch angle. A target mainfall angle may be determined based on the implement pitch signal and the filtered chassis pitch angle. A difference angle may be determined based on the target mainfall angle, the implement pitch signal, and the chassis pitch signal. A position of the implement may be changed based on the difference angle.

According to yet another aspect of the present disclosure, a method for controlling an implement of a machine may include receiving at a controller an operator command signal and a chassis pitch signal. An operator desired implement mainfall angle rate may be determined based on the operator command signal. The chassis pitch signal may be filtered using a high pass filter to produce a filtered chassis pitch rate. A target implement mainfall angle may be determined based on the operator desired implement mainfall angle rate and the filtered chassis pitch rate. An augmented operator command signal may be determined based on the target implement mainfall angle rate. The method may further include changing a position of the implement based on the augmented operator command signal.

BRIEF DESCRIPTION OF THE DRAWINGS

The accompanying drawings, which are incorporated in and constitute a part of this specification, illustrate various exemplary embodiments, and together with the description serve to explain the principles of the disclosed embodiments.

DETAILED DESCRIPTION

Figure 1:
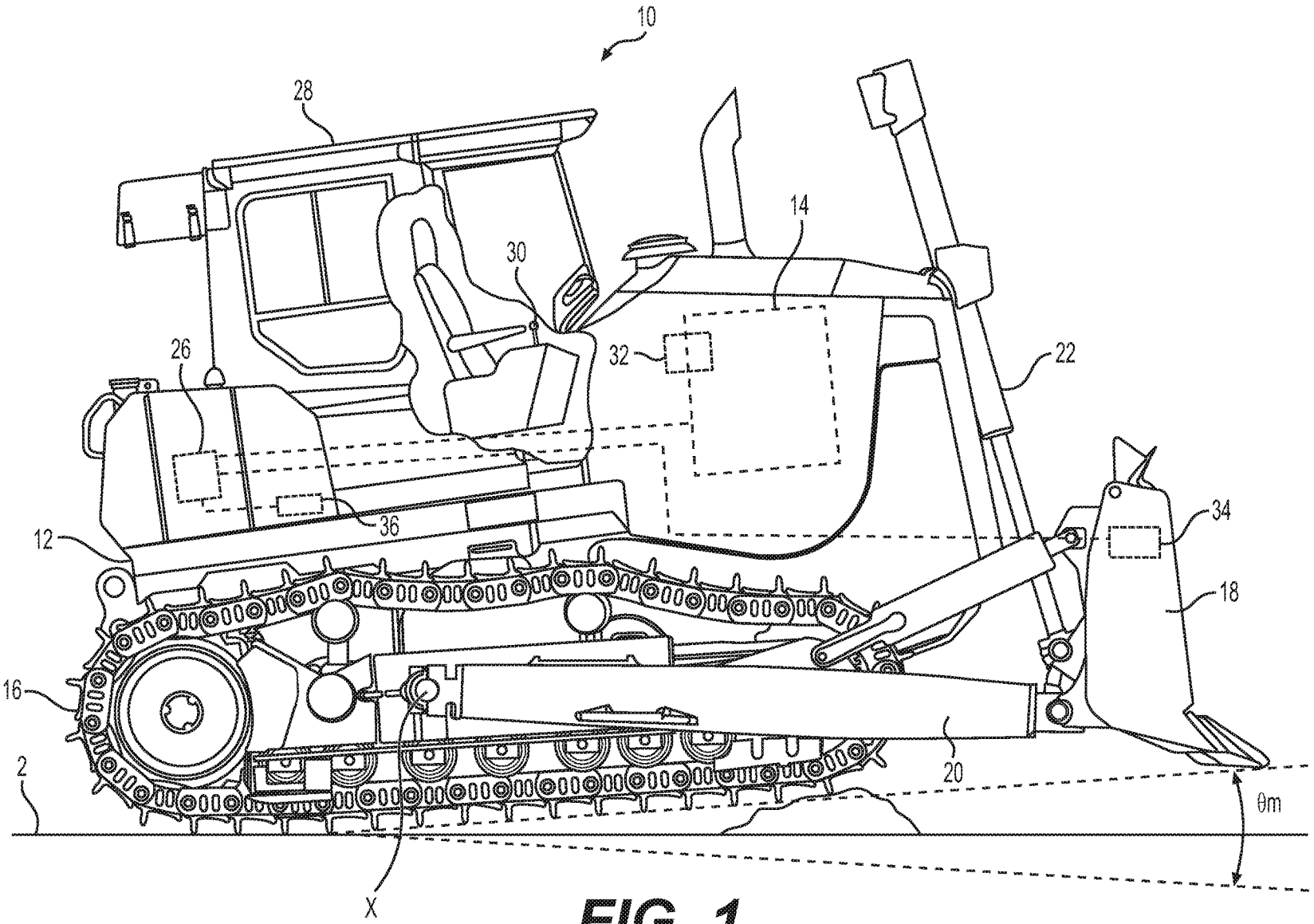
FIG. 1 illustrates an exemplary machine according to aspects of the present disclosure.

Reference will now be made in detail to specific embodiments or features, examples of which are illustrated in the accompanying drawings. Generally, corresponding or similar reference numbers will be used, when possible, throughout the drawings to refer to the same or corresponding parts. Features in the drawings may not be drawn to scale, but may rather be drawn to highlight different aspects of the disclosure. In this disclosure, relative terms, such as, for example, "about," "generally," and "substantially" are used to indicate a possible variation of ±10% in a stated numeric value.

FIG. 1 illustrates an exemplary machine in the form of a tractor 10 including an implement, blade 18. The tractor 10 may include a chassis 12 and an engine 14. The engine 14 may drive tracks 16 to propel the tractor 10 across a ground surface 2. The blade 18 may be pivotably connected to the chassis 12 by an arm 20, e.g., at a pivot point X. Rotation of the arm 20 may raise or lower blade 18. A hydraulic actuator 22 may be coupled between the chassis 12 and the blade 18. Actuating hydraulic actuator 22, e.g., by operating one or more valves and/or solenoids, may move blade 18. For example, extending hydraulic actuator 22 may lower the blade 18 and rotate the arm 20 clockwise about pivot point X. In another example, retracting the hydraulic actuator 22 may raise the blade 18 and rotate the arm 20 counterclockwise about pivot point X. Although FIG. 1 illustrates a tractor 10 having a blade 18 implement this only exemplary. The present disclosure may be applicable to other work machines (e.g., loaders or excavators) having other types of implements (e.g., augers, forks, buckets, hammers, plows, etc.).

Figure 2:
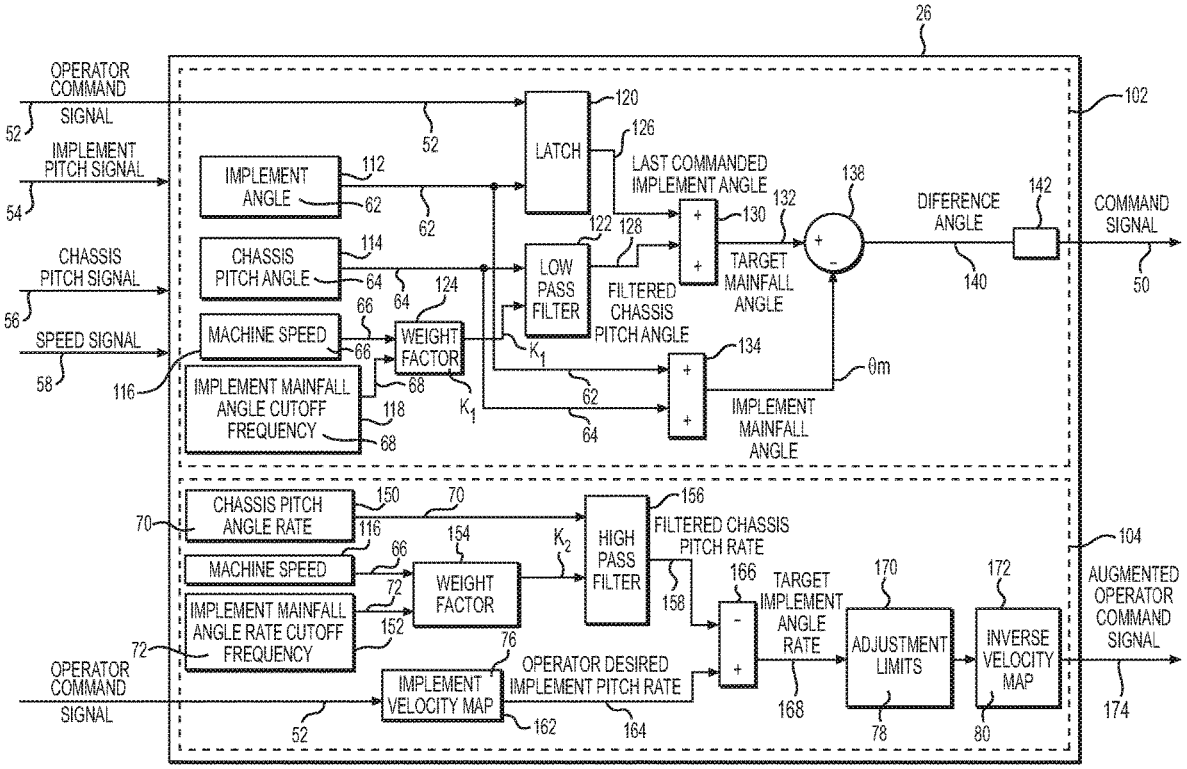
FIG. 2 shows exemplary controller architecture for a controller of the machine of FIG. 1 including functional modules, inputs, and outputs.

Operation of the tractor 10 may be initiated by an operator in a cab 28 located on chassis 12. The cab 28 may include one or more operator controls 30, such as, e.g., one or more implements, screens, buttons, joysticks, or switches. The operator controls may send signals to a controller 26. For example, one of the operator controls may send an activation signal to activate an operating mode of the controller 26, such as, e.g., activating one of the systems of the controller 26 described below. In another example, the operator controls may transmit a deactivation signal to controller 26 to deactivate a system of the controller 26. In some examples, operator controls 30 may be used for commanding movement and positioning of the blade 18. For example, moving a joystick 30 forward may lower the blade 18, and moving the joystick 30 backward may raise the blade 18. Movement of the joystick 30 by the operator may transmit an operator command signal 52 to controller 26, as shown in FIG. 2. The operator command signal 52 may be indicative of a direction and speed at which the operator commands movement of the blade 18. The joystick 30 may be configured to automatically return to a "neutral" position if the operator is not actively moving the joystick 30.

With reference to FIGS. 1 and 2, the tractor 10 may include one or more sensors to measure position and movement of the tractor 10 and/or the blade 18. For example, the tractor 10 may include a speed sensor 32 to measure a "machine speed" 66, that is, the speed of tractor 10 moving along the ground surface 2. The speed sensor 32 may measure the machine speed 66 using any number of known techniques or measurements, including, but not limited to, engine speeds, transmission settings, or direct measurement, e.g., via GPS. The speed sensor 32 may send a speed signal 58, indicative of the machine speed 66, to the controller 26.

Turning back to FIG. 1, the tractor 10 may be equipped with one or more inertial measurement units (IMUs). The tractor 10 may include an IMU located on the chassis 12 (chassis IMU 36) and an IMU located on the blade 18 (implement IMU 34). An IMU may include one or more accelerometers and one or more gyroscopes. IMUs may measure acceleration in one or more dimensions or degrees of freedom. Based on acceleration of the IMU, the IMU or the controller 26 may determine velocity and position information associated with the IMU's location. The constant acceleration on each IMU due to gravity enables the IMUs to measure the position, velocity, and acceleration with respect to gravity, or an axis orthogonal to gravity. For example, the chassis IMU 36 may measure an angular position and angular velocity of the chassis 12 with respect to gravity. In some examples, each IMU may include a state estimator, such as, e.g., a Kalman filter or a complimentary filter, to remove systematic errors from the IMU measurements including, but not limited to, sensor bias and non-gravitational acceleration.

Before proceeding further, it may be beneficial to define certain measurements and terms characterizing the operation of the tractor 10 and/or the blade 18, as illustrated in FIGS. 1 and 2. As referred to herein, a "chassis pitch angle" 64 means the angle of the chassis 12 with respect to a longitudinal axis that is orthogonal with respect to gravity. A "chassis pitch angle rate" 70 refers to the angular velocity of the chassis 12 with respect to a longitudinal axis orthogonal to gravity, that is, the rate of change of the chassis pitch angle 64. An "implement angle" 62 refers to the angle of rotation of the blade 18 about pivot connection X with respect to the chassis 12. An "implement mainfall angle," $\Theta_M$, refers to the angle of blade 18 with respect to a longitudinal axis orthogonal to gravity. A "target implement mainfall angle" 132 defined herein as the angle of the blade 18 with respect to a longitudinal axis orthogonal to gravity determined based on the implement angle 62 last commanded by the operator and the chassis pitch angle 64 as-filtered by a low pass filter. An "implement velocity map" 76 may refer to a map, table, chart, array, database, or other collection of information relating the velocity of the implement, blade 18, to the operator command signal 52, such as, e.g., a map from which the velocity of the blade 18 may be determined by its relation to the magnitude and/or direction of the operator command signal 52. The implement velocity map 76 may be stored in memory accessible by the controller 26. An "operator desired implement pitch rate" 164 refers to the angular velocity at which the blade 18 would move with respect to the chassis 12 if the operator command signal 52 was fully executed. The foregoing measurements may be taken by one or more of the sensors. For example, the chassis IMU 36 may generate a chassis pitch signal 56 indicative, directly or indirectly of, the chassis pitch angle 64 and/or the chassis pitch angle rate 70. The implement IMU 34 may generate an implement pitch signal 54 indicative, directly or indirectly, of the implement angle 62.

The controller 26 may include one or more microprocessors. The controller 26 may be separate from, or integral with, a control system for operating the engine 14. The controller 26 may include memory for storing and accessing information. As shown in FIG. 2, the controller 26 may receive one or more inputs or signals, including, but not limited to the operator command signal 52, the implement pitch signal 54, the chassis pitch signal 56, and the speed signal 58. Based in part on these signals, the controller 26 may adjust the movement and position of the blade 18 to compensate for changes in pitch of the tractor 10.

With continued reference to FIG. 2, the controller 26 may include one or more functional modules and systems, such as, e.g., a stabilization system 102 to process and control the movement and position of blade 18 during operation of tractor 10 when the operator is not actively instructing movement of blade 18. The stabilization system 102 may maintain blade 18 at a relatively constant implement mainfall angle $\Theta_M$ while accommodating for low frequency fluctuations the implement mainfall angle $\Theta_M$ resulting from the tractor 10 moving across the ground surface 2. The stabilization system 102 may adjusting the position of blade 18 based only on the low frequency fluctuations by rejecting high frequency changes to the implement mainfall angle $\Theta_M$. Low frequency fluctuations of the implement mainfall angle $\Theta_M$ may be caused by changes in the trends of the terrain along the ground surface 2, such as, e.g., changes in the slope of ground surface 2. High frequency disturbances of the implement mainfall $\Theta_M$ may be caused by short bumps or other irregularities along ground surface 2. The stabilization system 102 may include a module 114 to determine the chassis pitch angle 64 based on the chassis pitch signal 56. The stabilization system 102 may include a module 112 to determine the implement angle 62 based on the implement pitch signal 54. The stabilization system 102 may include a latch 120 configured to receive the operator command signal 52. The latch 120 may trigger based on the operator command signal 52. For example, transitioning the joystick 30 to the neutral position may send an operator command signal 52 to controller 26 that triggers latch 120. Once triggered, the latch 120 may pass the current implement angle 62 through the latch to generate the last commanded implement angle 126. The last commanded implement angle 126 may be indicative of the implement angle 62 measured at the time the joystick 30 transitions to the neutral position. A module 134 may compare the chassis pitch angle 64 with the implement angle 62 to determine the implement mainfall angle $\Theta_M$. Module 134 may transmit the implement mainfall angle $\Theta_M$ to a module 138.

The controller 26 may include a low pass filter 122. The low pass filter 122 may be weighted or adjusted based on the machine speed 66 and an implement mainfall angle cutoff frequency 68. A module 118 may determine the implement mainfall angle cutoff frequency 68. The implement mainfall angle cutoff frequency 68 may be a static value stored in memory accessible by the controller 26. In at least some examples, the implement mainfall angle cutoff frequency 68 may be adaptively determined based on perceived operator application of the machine, e.g., fine grading applications may use a relatively low frequency and bulk earthmoving applications may use a relatively high frequency. The implement mainfall angle cutoff frequency 68 may ensure that the machine speed 66 is not used to adjust the low pass filter 122 if the tractor 10 is moving too slowly or too fast for the low pass filter 122 to accurately filter the chassis pitch angle 64. The low pass filter 122 may be adjusted based on a weight factor, $K_1$, determined at a module 124 from comparing the machine speed 66 and the implement mainfall angle cutoff frequency 68. The low pass filter 122 may filter the chassis pitch angle 64 to determine a filtered chassis pitch angle 128. By utilizing the low pass filter 122, the filtered chassis pitch angle 128 may be determined in part based on the change in the chassis pitch angle 64 over time.

The stabilization system 102 may compare the last commanded implement angle 126 to the filtered chassis pitch angle 128 to determine a target implement mainfall angle 132. The implement mainfall angle $\Theta_M$ may be compared to the target implement mainfall angle 132 at the module 138 to determine a difference angle 140. At a module 142, the controller 26 may generate a command signal 50 for directing movement of the blade 18 based on the difference angle 140. In some examples, module 142 may correspond to a distinct controller, e.g., a PID controller. The command signal 50 may initiate movement of the blade 18 to the target implement mainfall angle 132, e.g., by actuation hydraulic actuator 22.

Figure 3:
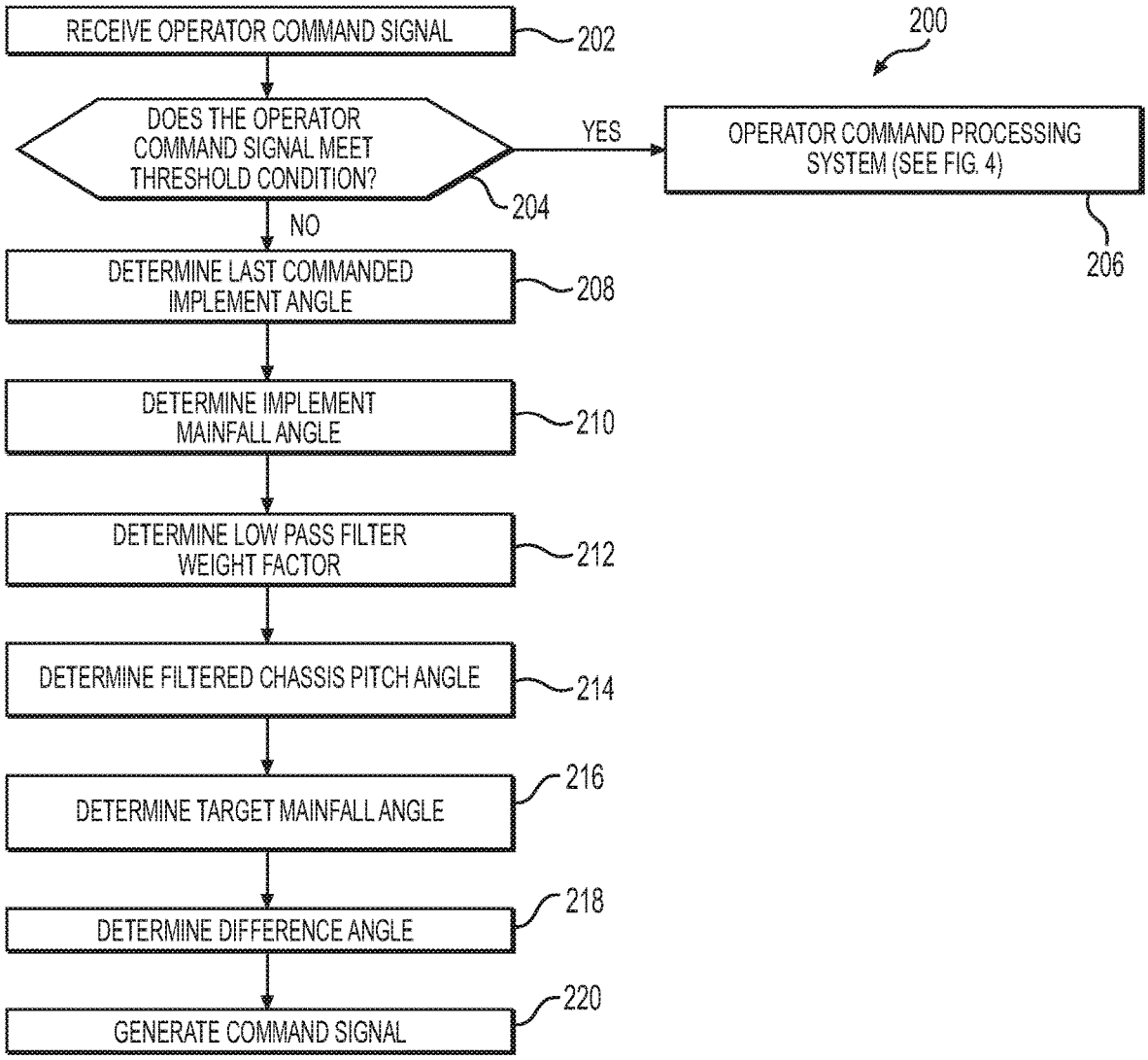
FIG. 3 shows a method of controlling an implement of the machine of FIG. 1.

With reference now to FIG. 3, a flowchart of a blade stabilization routine 200 for controlling the position of blade 18 with stabilization system 102 is shown. At step 202 the operator command signal 52 transmitted by the joystick 30 may be received at the controller 26. At decision 204, the operator command signal 52 may be compared to one or more threshold condition(s) to determine whether the operator command signal 52 meets or exceeds the threshold condition(s). Exemplary threshold conditions include, but are not limited to, the magnitude and/or rate of change of the position of blade 18 commanded by the operator, e.g., the operator command signal 52 indicating the operator moved joystick 30 sufficiently away from the "neutral" setting. If the operator command signal 52 meets the threshold condition(s) the controller 26 may proceed to step 206, thereby engaging the operator command processing system 104, described below.

If the operator command signal 52 does not meet the threshold condition(s), and the stabilization system is active, the operator command signal may trigger the latch 120. Because the operator signal 52 has triggered the latch 120, the implement angle 62, determined from the implement pitch signal 54, may pass through the latch 120 to determine a last commanded implement angle 126 at step 208. At step 210, the implement angle 62 and the chassis pitch angle 64 may be compared to determine the implement mainfall angle $\Theta_M$. The machine speed 66 may be converted to a frequency and then compared to the implement mainfall angle cutoff frequency 68 to determine the weight factor $K_1$ for the low pass filter 122 at step 212. The weight factor $K_1$ may be applied to the low pass filter 122.

As adjusted by the weight factor $K_1$, the low pass filter 122 may process the chassis pitch angle 64, determined from the chassis pitch signal 56, to produce the filtered chassis pitch angle 128 at step 214. At step 216, controller 26 may compare the last commanded implement angle 126 with the filtered chassis pitch angle 128 to generate the target mainfall angle 132. At step 218, the target mainfall angle 132 may be compared to the implement mainfall angle $\Theta_M$ to determine the difference angle 140.

The difference angle 140 may be adjusted according to machine limitations, e.g., limitations on the movement and position of the tractor 10 and/or the blade 18. At step 220, the difference angle 140 may be converted into the command signal 50. For example, the controller 26 and/or a separate controller, such as, e.g., a PID controller, may convert the difference angle 140 into the command signal 50. The command signal 50 may be transmitted to the hydraulic actuator 22 in order to move the blade 18 to the target mainfall angle 132. The steps of blade stabilization routine 200 need not be performed in the order shown in FIG. 3.

Turning back to FIG. 2, the controller 26 may include an operator command processing system 104 to augment the operator command signal 52 so that the blade 18 moves more uniformly, e.g., compensating for vibrations and alterations in pitch of the tractor 10. The operator command processing system 104 may develop the chassis pitch angle rate 70 at a module 150. The operator command processing system 104 may retrieve or calculate an implement mainfall angle rate cutoff frequency 72 at a module 152. The implement mainfall angle rate cutoff frequency 72 may be a static value stored in memory or determined based on one or more characteristics of the operation of the tractor 10, as described above with respect to the implement mainfall angle cutoff frequency 68. The operator command processing system 104 may filter the chassis pitch angle rate 70, by applying a high pass filter 156 to determine a filtered chassis pitch rate 158. The high pass filter 156 may be adjusted in part based on the machine speed 66 determined by module 116. For example, a module 154 may determine a weight factor $K_2$ to be applied to high pass filter 156 based on the machine speed 66 and the implement mainfall angle rate cutoff frequency 72.

The operator command signal 52 may be converted into an operator desired implement pitch rate 164 by referencing the implement velocity map 76 with a module 162. A module 166 may compare the operator desired implement angle rate 164 to the filtered chassis pitch rate 158 to determine a target implement angle rate 168. The target implement angle rate 168 may be adjusted at a module 176 based on adjustment limits 78 of the machine, e.g., restrictions to avoid lowering the blade 18 too quickly and/or to avoid relatively large modification of the operator command signal 52. The operator command processing system 104 may reference an inverse velocity map 80 at a module 172 to generate an augmented operator command signal 174 based on the target implement angle rate 168. The controller 26 may transmit the augmented operator command signal 174 to move blade 18, e.g., by actuating the hydraulic actuator 22.

Figure 4:
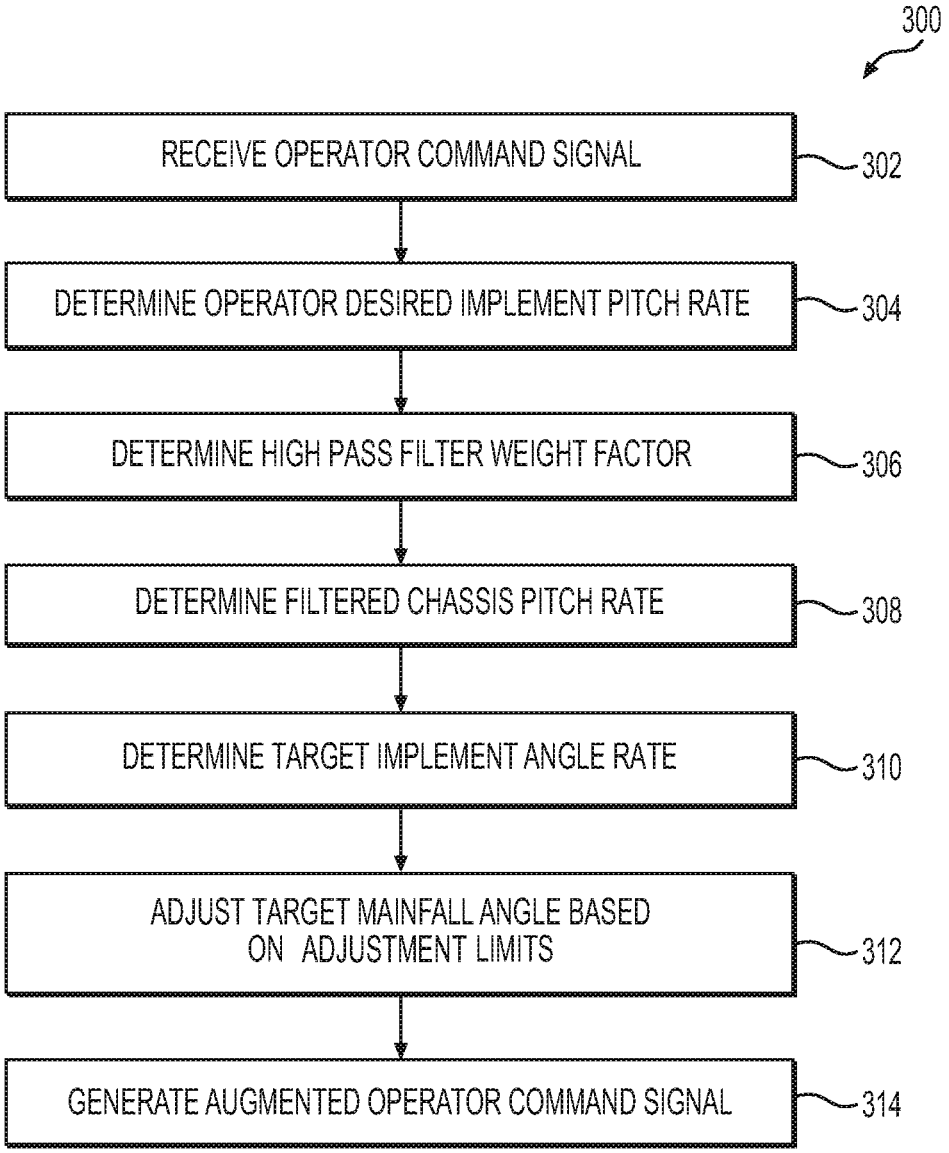
FIG. 4 shows another method of controlling the implement of the machine of FIG. 1.

FIG. 4 illustrates a method of operator command augmentation for implement stabilization 300, using the operator command processing system 104. At step 302, the operator command signal 52 may be received at controller 26. The operator command signal 52 may be compared to the implement velocity map 76 to determine the operator desired implement pitch rate 164 at step 304. The machine speed 66 may be compared to the implement mainfall angle rate cutoff frequency 72 to determine the weight factor $K_2$ for the high pass filter 156 at step 306. The high pass filter 156 may be adjusted according to the weight factor $K_2$. The chassis pitch angle rate 70 may be passed through the high pass filter 156, as adjusted, to determine the filtered chassis pitch rate at step 308. The filtered chassis pitch rate 158 may be compared with the operator desired implement pitch angle rate 164 to determine the target implement angle rate 168 at step 310. The target implement angle rate 168 may be adjusted based on the adjustment limits 78 of the implement and/or machine at step 312. An inverse implement velocity map 80 may be referenced using the target implement angle rate 168 to generate the augmented operator command signal 174 at step 314. The augmented operator command signal 174 may be transmitted to hydraulic actuator 22 to achieve steady movement of the blade 18 according to the operator's instructions.

Industrial Applicability

The present disclosure may find applicability in systems and methods for controlling an implement on a machine, such as, e.g., the blade 18 on the tractor 10. During operation, movement of the tractor 10 across uneven terrain of the ground surface 2 may cause the chassis 12 and the blade 18 to pitch forward and aft, affecting the position of blade 18 and therefore the grade cut into the ground surface 2 by the blade 18. The stabilization system 102 and/or the operator command processing system may control or augment movement of the blade 18 to adjust the implement mainfall angle $\Theta_M$ and refine instructed movement of the blade 18. Accordingly, the stabilization system 102 and the operator command processing system may produce a smooth grading profile of the ground surface 2 by augmenting or adjusting the implement mainfall angle $\Theta_M$ or operator commands to compensate for unintentional changes in the pitch of the tractor 10 and/or the blade 18. Exemplary scenarios of operating the tractor 10 using the systems and methods disclosed herein will now be described.

Figure 5A:
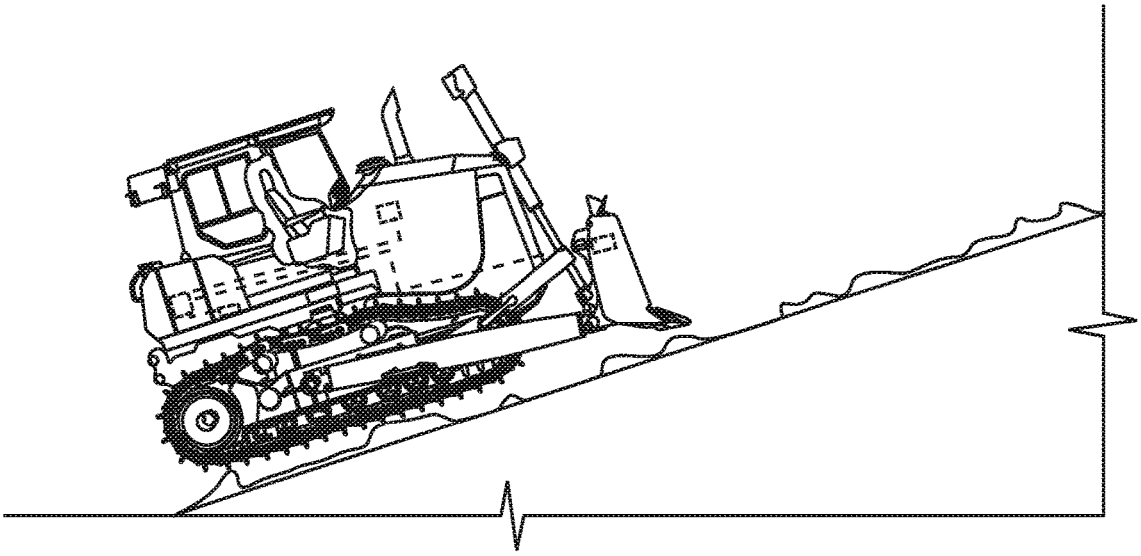
FIG. 5A shows an exemplary scenario of operating the machine of FIG. 1 in accordance with the method of FIG. 3.

One possible scenario, shown in FIG. 5A, is that the tractor 10 moves over an uneven ground surface 2 having a relatively steady slope of 5 degrees. The chassis pitch angle 64 is 5 degrees, with slight variation over recent distance covered by the tractor 10. The chassis 12 pitches upward 2 degrees upon encountering a bump in the ground surface 2. The stabilization system 102 is active. The joystick 30 returns to the neutral position thereby transmitting an operator command signal 52. The implement angle 62 is −1 degrees as determined from the implement pitch signal 54. The command signal 52 triggers latch 120 to process the implement angle 62 and produce the last commanded implement angle 126 of −1 degree. The implement mainfall angle $\Theta_M$ is calculated as 6 degrees by comparing the implement angle 62 and chassis pitch angle 64. Here, the implement mainfall angle $\Theta_M$ is the result of the initial chassis pitch angle of 5 degrees being increased by 2 degrees due to the bump and decreased by the implement angle of −1 degree. The low pass filter 122 is adjusted based on the machine speed 66 of tractor 10 and the implement mainfall angle cutoff frequency 68. The chassis pitch angle 64 is processed by the low pass filter 122 to determine the filtered chassis pitch angle 128 of 5.3 degrees (a difference of 0.3 degrees from the initial chassis pitch angle 64 of 5 degrees). The last commanded implement angle 126 and the filtered chassis pitch angle 128 are compared to determine the target implement mainfall angle 132 of 4.3 degrees (the filtered chassis pitch angle 128 of 5.3 degrees less the last commanded implement angle 126 of −1 degree). The target implement mainfall angle 132, 4.3 degrees, is compared to the implement mainfall angle $\Theta_M$, 6 degrees, to determine the difference angle 140 of −1.7 degrees. Consequently, the controller 26 sends the command signal 50 to hydraulic actuator 22 to move the blade 18 according to the difference angle 140, lowering the blade 18 by 1.7 degrees.

Figure 5B:
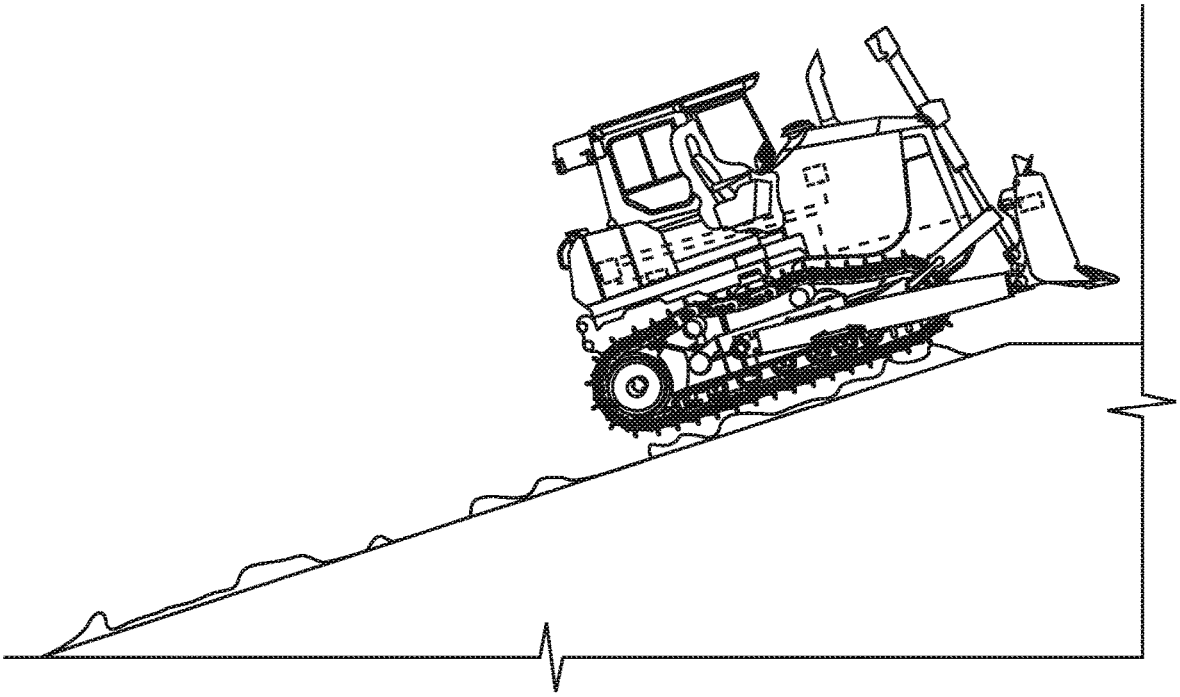
FIG. 5B shows exemplary scenario of operating the machine of FIG. 1 in accordance with the method of FIG. 4.

In another scenario, shown in FIG. 5B, the tractor 10 is moving along the ground surface 2 and encounters a point where a slope of the ground surface 2 changes abruptly from 5.0 degrees to 0.0 degrees, resulting in a −2.0 degree per second low frequency change to the chassis angle pitch rate 70. Simultaneously, the tractor 10 traverses a bump in ground surface 2 which raises the chassis 12 at 0.5 degrees per second. This abrupt change in chassis pitch rate 70 due to the bump may be considered a high frequency change to the chassis pitch rate 70. The operator moves the joystick 30 to command movement of blade 18 upward to counter the change in slope and the raise of the chassis 12 and the blade 18. Accordingly, an operator command signal 52 is transmitted to the controller based on the operator's movement of the joystick 30.

The operator command processing system 104 is active thereby allowing the operator command signal 52 to be received by controller 26. The operator command signal 52 is compared to the implement velocity map 76 to determine the operator desired implement pitch rate 164 of 2.0 degrees per second. The controller 26 determines the machine speed 66 based on the speed signal 58. The machine speed 66 is compared to the implement mainfall angle rate cutoff frequency 72 in order to determine a weight factor $K_2$ to adjust the high pass filter 156. The chassis pitch angle rate 70 of −1.5 degrees per second is determined from the chassis pitch signal 56 received at the controller 26. In this case, the chassis pitch angle rate 70 of −1.5 degrees is the result of the changes in the chassis pitch angle rate 70 due to the change in slope of the ground surface 2 (−2.0 degrees per second) and the bump (0.5 degrees per second). The chassis pitch angle rate 70 is processed by the adjusted high pass filter 156 to determine the filtered chassis pitch angle rate 158 of 0.5 degrees per second. Accordingly, the filtered chassis pitch angle rate 158 corresponds to the high frequency change in chassis pitch angle rate 70.

The controller 26 compares the operator desired implement pitch rate 164 of 2.0 degrees per second and the filtered chassis pitch angle rate 158 of 0.5 degrees per second to determine a target implement angle rate of 1.5 degrees per second. The target implement angle rate 168 is compared to stored values of adjustment limits 78 for blade 18. The target implement angle rate 168 is translated into the augmented operator command signal 174 using the inverse implement velocity map 80. The controller 26 issues the augmented operator command signal 174 thereby instructing the hydraulic actuator 22 to move blade 18 at 1.5 degrees per second according to the augmented operator command signal 174.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It may be intended that the specification and examples be considered as exemplary only, with a true scope and spirit of the invention being indicated by the following claims.

What is claimed is:

1. A control system for controlling a position and/or movement of an implement of a machine, comprising:

a chassis;

the implement, wherein the implement is attached to the chassis;

a first sensor configured to generate a first signal indicative of an angle of the implement with respect to the chassis;

a second sensor configured to generate a second signal indicative of an angle of the chassis with respect to gravity; and a controller in communication with the first and second sensors configured to:

determine an implement mainfall angle based on the first signal and the second signal;

process the second signal using a low pass filter to determine a filtered chassis pitch angle, wherein the controller is configured to determine a first weight actor based in part on a machine speed, and adjust the low pass filter based on the first weight factor;

determine a target mainfall angle based on the first signal and the filtered chassis pitch angle; and generate a command signal based on the target mainfall angle and the implement mainfall angle in order to adjust the position of the implement.

2. The control system of claim 1, wherein the command signal based on the target mainfall angle and the implement mainfall angle is a first command signal, and wherein the control system further includes an operator control configured to generate a second command signal indicative of the desired movement of the implement; wherein the second command signal is also indicative of a chassis pitch rate; and wherein the controller is further configured to:

determine the chassis pitch rate from the second command signal, determine an operator desired implement pitch rate based on the second command signal, filter the chassis pitch rate using a high pass filter to produce a filtered chassis pitch rate, compare the operator desired implement pitch rate and the filtered chassis pitch rate to generate an augmented operator command signal, and transmit the augmented operator command signal to move the implement.

3. The control system of claim 2, wherein the controller is further configured to determine a second weight factor based on the machine speed and adjust the high pass filter based on the second weight factor.

4. The control system of claim 1, further including an operator control configured to generate an operator command signal indicative of a desired implement angle, wherein the controller is further configured to determine the target mainfall angle based on the operator command signal and the implement pitch signal.

5. The control system of claim 4, wherein the controller is configured to determine whether the operator signal meets one or more threshold conditions before changing the position of the implement based on the target mainfall angle.

6. The control system of claim 1, wherein the controller is configured to determine the command signal by referencing a PID controller.

7. The control system of claim 1, wherein the implement is a blade.

8. A method of controlling an implement of a machine relative to a ground surface, comprising:

receiving at a controller an implement pitch signal indicative of an angle of the implement with respect to a chassis, a chassis pitch signal indicative of an angle of the chassis with respect to gravity, and a speed signal indicative of a speed of the machine;

receiving a command signal and triggering a latch;

adjusting a low pass filter based on the speed signal;

filtering the chassis pitch signal through the low pass filter to produce a filtered chassis pitch angle;

determining a target mainfall angle based on the implement pitch signal and the filtered chassis pitch angle;

determining a difference angle based on the target mainfall angle, the implement pitch signal, and the filtered chassis pitch signal; and changing a position of the implement based on the difference angle, wherein triggering the latch initiates the step of determining the target mainfall angle.

9. The method of claim 8, wherein the command signal is an operator command signal; and the method further including:

determining an operator desired implement pitch rate based on the operator command signal;

filtering the chassis pitch signal using a high pass filter to determine a filtered chassis pitch rate;

determining a target implement angle rate based on the operator desired implement pitch rate and the filtered chassis pitch rate; and moving the implement based on the target implement angle rate.

10. The method of claim 9, further including:

determining a weight factor based on the speed signal; and adjusting the high pass filter based on the weight factor.

11. The method of claim 10, wherein moving the implement includes actuating a hydraulic actuator.

12. The method of claim 9, wherein the implement is moved based on the target implement angle rate as adjusted by one or more adjustment limits.

13. The method of claim 12, wherein changing the position of the implement includes moving the implement at a relatively constant velocity.

14. The method of claim 9, further including comparing the operator command signal to one or more threshold conditions, wherein the implement is moved based on the target implement angle rate if the one or more threshold conditions are met by the operator command signal and the implement is moved based on the difference angle if the one or more threshold conditions are not met by the operator command signal.

15. The method of claim 9, wherein the low pass filter is adjusted based on an implement mainfall angle cutoff frequency determined based on the type of work performed by the machine.

16. The method of claim 9, wherein the operator desired implement pitch rate is determined by referencing an implement velocity map.

17. A method for controlling an implement of a machine relative to a ground surface, comprising:

receiving at a controller an operator command signal and a chassis pitch signal;

determining whether the operator command signal meets one or more threshold conditions;

determining an operator desired implement mainfall angle rate based on the operator command signal;

filtering the chassis pitch signal using a high pass filter to produce a filtered chassis pitch rate;

determining a target implement mainfall angle based on the operator desired implement mainfall angle rate and the filtered chassis pitch rate;

determining an augmented operator command signal based on the target implement mainfall angle; and changing a position of the implement based on the augmented operator command signal if the operator command signal meets one or more of the one or more threshold conditions.

18. The method of claim 17, further including determining a weight factor based on a machine speed, and adjusting the high pass filter according to the weight factor.

19. The method of claim 17, further including triggering a latch, wherein triggering the latch initiates determination of the target implement mainfall angle.

20. The method of claim 17, wherein changing the position of the implement includes actuating a hydraulic actuator.

* * * * *